US011760600B2

(12) United States Patent
Mitsuhashi et al.

(10) Patent No.: US 11,760,600 B2
(45) Date of Patent: Sep. 19, 2023

(54) SPINDLE UNIT

(71) Applicant: OGURA CLUTCH CO., LTD., Gunma (JP)

(72) Inventors: Takashi Mitsuhashi, Gunma (JP); Yoshiyuki Matsumoto, Gunma (JP); Nobuyuki Shuto, Gunma (JP); Tatsuya Hotta, Gunma (JP)

(73) Assignee: OGURA CLUTCH CO., LTD, Gunma (JP)

( * ) Notice: Subject to any disclaimer, the term of this patent is extended or adjusted under 35 U.S.C. 154(b) by 285 days.

(21) Appl. No.: 17/346,899

(22) Filed: Jun. 14, 2021

(65) Prior Publication Data

US 2021/0395037 A1 Dec. 23, 2021

(30) Foreign Application Priority Data

Jun. 17, 2020 (JP) ..... 2020-104312

(51) Int. Cl.

| | |
|---|---|
| ***B65H 49/26*** | (2006.01) |
| ***B65H 59/40*** | (2006.01) |
| ***B65H 59/04*** | (2006.01) |
| ***B65H 59/38*** | (2006.01) |

(52) U.S. Cl.

CPC ..... *B65H 49/26* (2013.01); *B65H 59/04* (2013.01); *B65H 59/387* (2013.01); *B65H 59/40* (2013.01); *B65H 2701/31* (2013.01)

(58) Field of Classification Search

CPC ..... B65H 49/26; B65H 59/04; B65H 59/387; B65H 59/40; B65H 2701/31

See application file for complete search history.

(56) References Cited

FOREIGN PATENT DOCUMENTS

| | | | |
|---|---|---|---|
| JP | 10-310955 A | | 11/1998 |
| JP | 2006003125 A | * | 1/2006 |
| JP | 6392757 B2 | | 9/2018 |

OTHER PUBLICATIONS

Machine Translation of JP 2006-003125 A, Jan. 5, 2006. (Year: 2006).*

* cited by examiner

*Primary Examiner* — William E Dondero

(74) *Attorney, Agent, or Firm* — WOMBLE BOND DICKINSON (US) LLP

(57) ABSTRACT

A spindle unit includes a swing mechanism fixed to a fixed frame, a support member swingably supported by the swing mechanism, a spindle main body and an electromagnetic brake supported by the support member. The spindle main body rotates integrally with a bobbin around which a yarn is wound. The electromagnetic brake applies a resistance to the rotating spindle main body. The swing mechanism includes a fixed attachment member fixed to the fixed frame, a swing shaft supported by the fixed attachment member, a spring, and a sensor. The spring applies a spring force to the support member in a direction opposite to a direction in which the support member swings by the tension of the yarn. The sensor detects the tilt amount of the support member when the support member swings.

15 Claims, 11 Drawing Sheets

SPINDLE UNIT

BACKGROUND OF THE INVENTION

This application is based upon and claims the benefit of priority from Japanese patent application No. 2020-104312, filed on Jun. 17, 2020, the disclosure of which is incorporated herein in its entirety by reference.

The present invention relates to a yarn supply spindle unit that supports a bobbin around which a yarn to be supplied to a weaving machine or the like is wound.

When supplying a yarn of carbon fibers or the like to a weaving machine, a bobbin around which the yarn is wound is attached to a rotatable spindle. When drawing out the yarn from the bobbin, as disclosed in, for example, Japanese Patent Laid-Open No. 10-310955 (literature 1), a braking force is made to act on the spindle, thereby applying a tension to the yarn to be drawn.

If the braking force applied to the spindle is constant, the tension increases as the yarn is consumed, and the yarn-winding diameter of the bobbin decreases.

For this reason, in the apparatus disclosed in literature 1, the tension of the yarn is actually measured by bringing the yarn into contact with a roller, and the magnitude of the braking force is adjusted based on the magnitude of the measured tension.

There is also known a spindle unit that reads the yarn-winding diameter using an ultrasonic sensor and adjusts the braking force in accordance with the winding diameter.

When a mechanical component such as a roller is brought into contact with a yarn to actually measure the tension of the yarn, the yarn may be damaged to cause, for example, fluff. Such a defect can be eliminated by employing a configuration that obtains the tension in a noncontact state using an ultrasonic sensor. However, the ultrasonic sensor is an expensive device difficult to install and adjust, and cannot therefore easily be used.

SUMMARY OF THE INVENTION

It is an object of the present invention to provide a spindle unit capable of easily and inexpensively detecting the tension of a yarn in a noncontact state.

In order to achieve the above object of the present invention, there is provided a spindle unit comprising a swing mechanism fixed to a fixed frame, a support member swingably supported by the swing mechanism, a spindle main body rotatably supported by the support member, detachably inserted into an axial portion of a bobbin around which a yarn is wound, and configured to rotate integrally with the bobbin, and an electromagnetic brake supported by the support member and configured to apply a resistance to the spindle main body when the spindle main body is rotating, wherein the swing mechanism includes a fixed attachment member fixed to the fixed frame, a swing shaft supported by the fixed attachment member and configured to support the support member such that the support member swings by a tension of the yarn when the yarn is drawn from the bobbin, a spring configured to apply a spring force to the support member in a direction opposite to a direction in which the support member swings by the tension of the yarn, and a sensor configured to detect a tilt amount of the support member when the support member swings by the tension of the yarn against the spring force of the spring.

DESCRIPTION OF THE PREFERRED EMBODIMENTS (First Embodiment) A spindle unit according to the first embodiment of the present invention will now be described in detail with reference to FIGS. 1 to 9. As for directions in the following description of the configuration of the spindle unit, the right side in FIG. 1 will be defined as the front side, and the left side as the rear side for the descriptive convenience.

Figure 1:
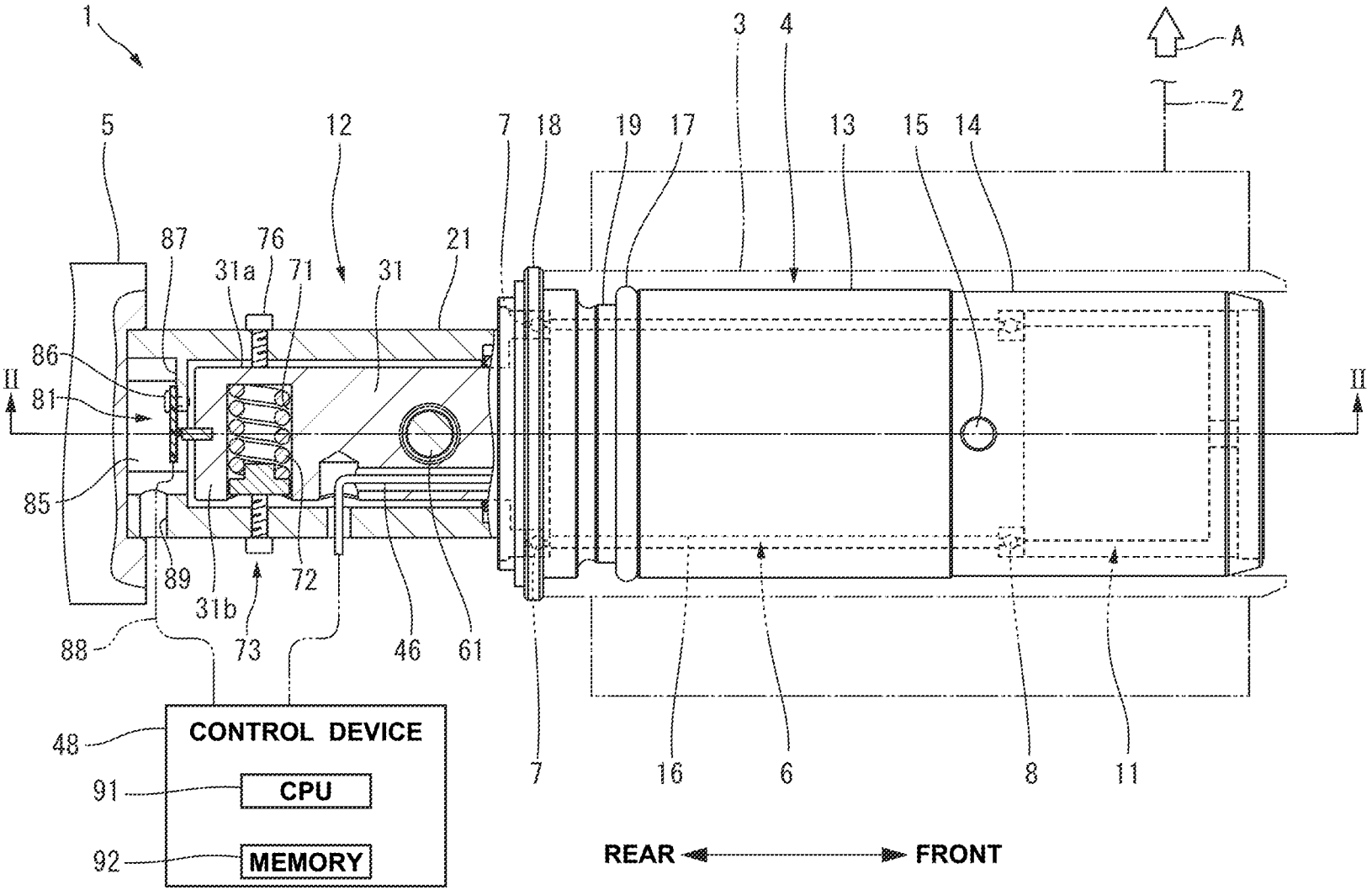
FIG. 1 is a plan view showing a spindle unit according to the first embodiment in which a main part is cut away.

A spindle unit 1 shown in FIG. 1 is a yarn supply spindle unit used in a creel (not shown) configured to draw a special yarn 2 (to be simply referred to as a yarn hereinafter) made of carbon fibers. The yarn 2 is wound around a bobbin 3 and held. The bobbin 3 is formed into a cylindrical shape. A spindle main body 4 (to be described later) of the spindle unit 1 is detachably inserted into the hollow portion (axial portion) of the bobbin 3. The spindle main body 4 is inserted into the bobbin 3 from an end portion on the right side in FIG. 1.

The spindle unit 1 projects in a cantilever form frontward from a fixed frame 5 of the creel shown on the leftmost side in FIG. 1. The spindle unit 1 has first to third functions.

The first function is a function of rotatably supporting the spindle main body 4 such that the spindle main body 4 can rotate together with the bobbin 3 when the yarn 2 is drawn. The first function is implemented by a support member 6 inserted into the spindle main body 4, and bearings 7 and 8 provided between the support member 6 and the spindle main body 4.

The second function is a function of applying a resistance to the rotating spindle main body 4. The second function is implemented using an electromagnetic gap type brake 11 (to be simply referred to as an electromagnetic brake 11 hereinafter) provided at the front end portion of the support member 6.

The third function is a function of detecting the tension of the yarn 2 in a noncontact state by tilting the spindle main body 4 at a tilt angle according to the magnitude of the tension of the yarn 2. The third function is implemented using a swing mechanism 12 provided between the support member 6 and the fixed frame 5.

Figure 2:
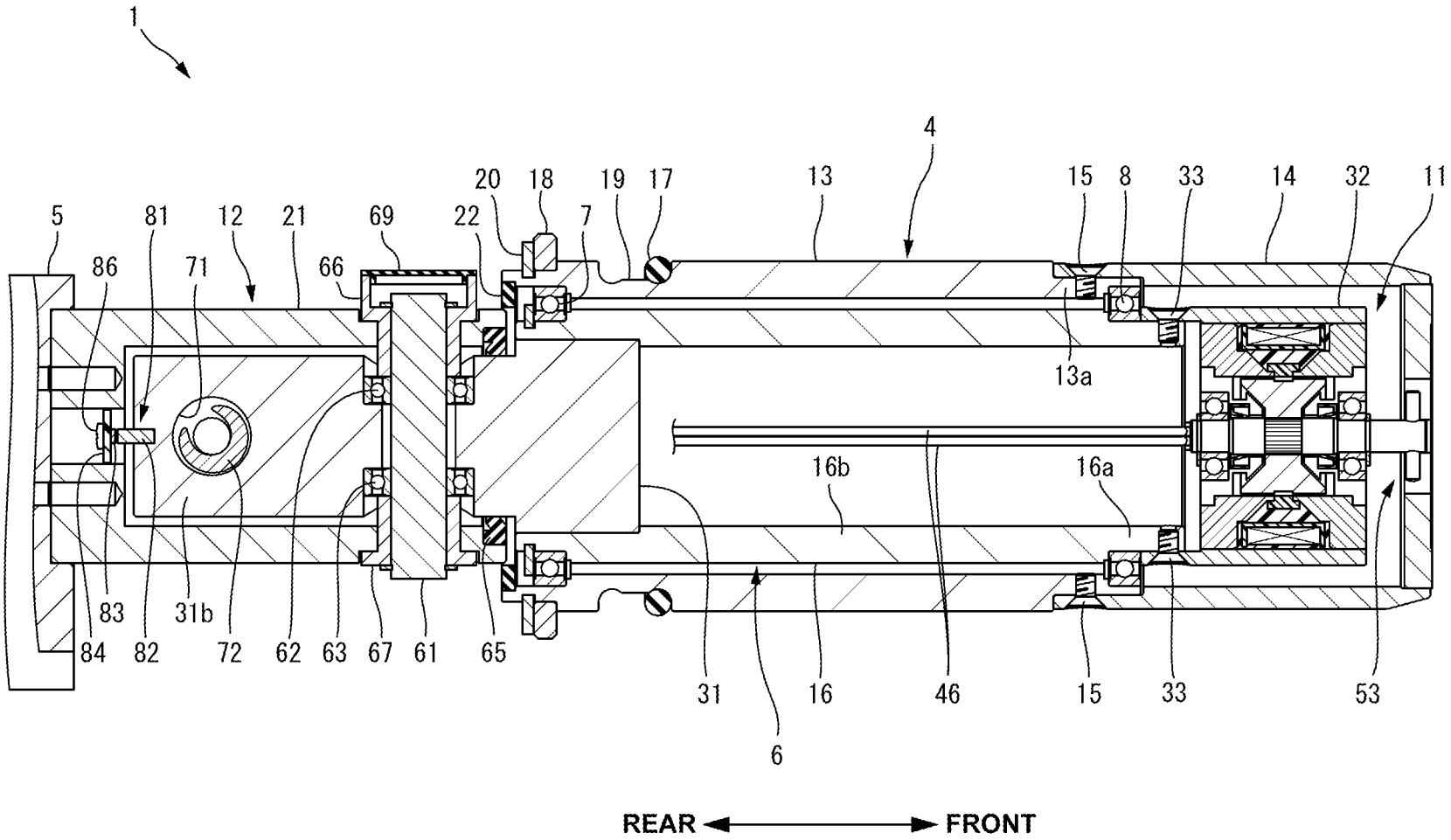
FIG. 2 is a sectional view taken along a line II-II in FIG. 1.

(Spindle Main Body) As shown in FIG. 2, the spindle main body 4 is formed into a cylindrical shape to be detachably inserted into the axial portion of the bobbin 3. The cutaway position of FIG. 2 is a position indicated by a line II-II in FIG. 1. The spindle main body 4 is configured to form one cylindrical body by combining two cylinders. The two cylinders are a spindle base 13 extending frontward from the rear end of the spindle main body 4 and a front tube 14 connected to the front end portion of the spindle base 13.

Figure 3:
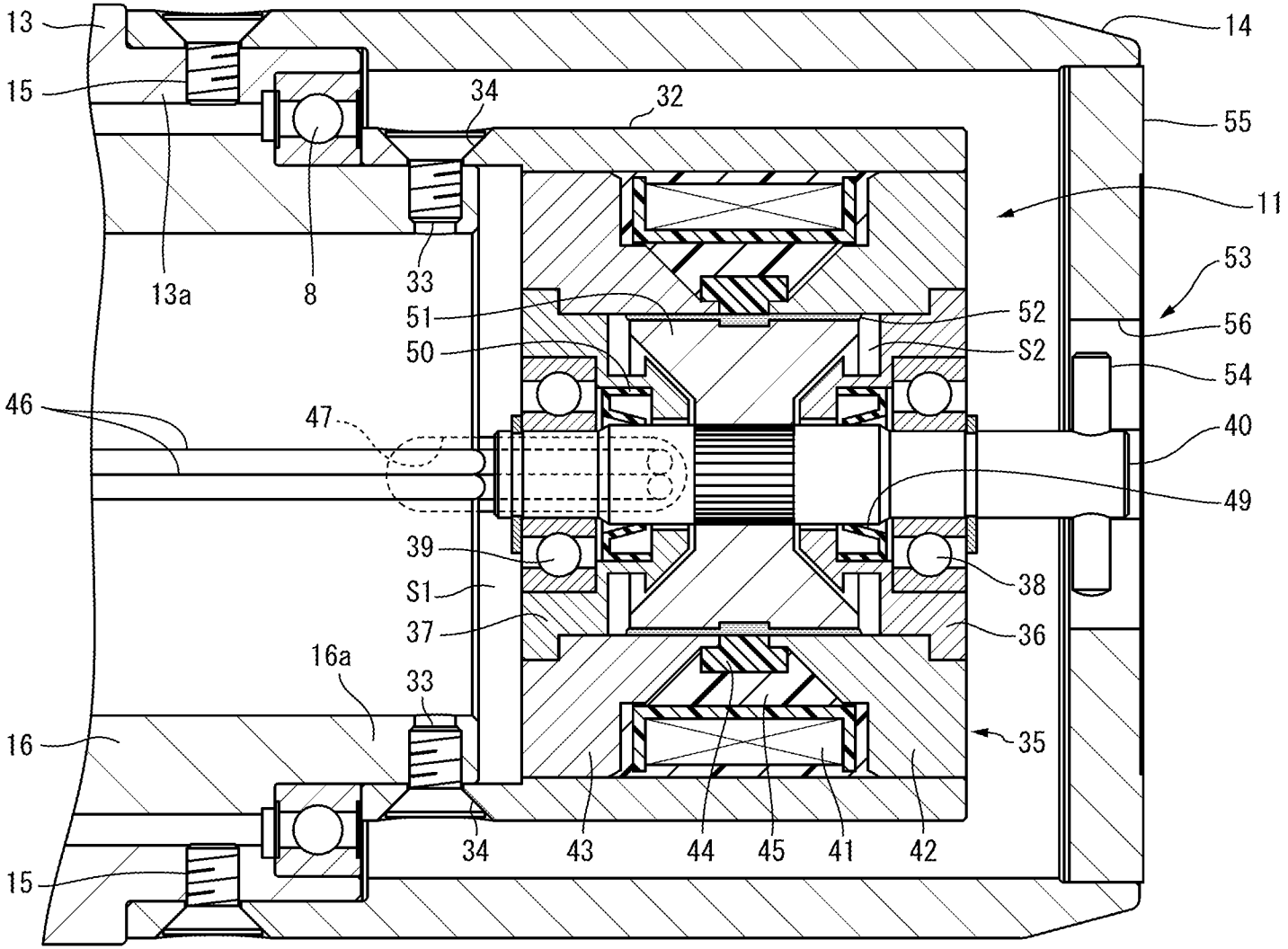
FIG. 3 is a sectional view of an electromagnetic brake.

Each of the spindle base 13 and the front tube 14 is formed by a cylinder that can be fitted in the bobbin 3. As shown in FIG. 3, the front tube 14 is fitted on the outer peripheral surface of a small-diameter portion 13*a* of the spindle base 13, and fixing screws 15 that extend through the front tube 14 in the radial direction are screwed into the small-diameter portion 13*a*, thereby connecting the spindle base 13 and the front tube 14. FIG. 3 is a sectional view showing a part of FIG. 2 in an enlarged state.

As shown in FIG. 2, a cylindrical body 16 (to be described later) of the support member 6 is inserted into the spindle base 13. The spindle base 13 is rotatably supported by the cylindrical body 16 via the bearings 7 and 8 at the two end portions in the front-and-rear direction. For this reason, when the yarn 2 is drawn, the spindle main body 4 rotates about the cylindrical body 16.

An O-ring 17 and an abutment member 18 are provided at the rear end portion of the outer peripheral portion of the spindle base 13. The O-ring 17 is fitted in an annular concave portion 19 of the spindle base 13 and attached. The O-ring 17 is formed by an elastic material such as rubber or an elastomer and applies a frictional resistance to the bobbin 3 that moves with respect to the spindle main body 4. Since the O-ring 17 is interposed between the bobbin 3 and the spindle base 13, the bobbin 3 and the spindle main body 4 integrally rotate when the yarn 2 is drawn.

The annular concave portion 19 has a predetermined length in the axial direction of the spindle main body 4 and is formed such that the O-ring 17 can move, in the annular concave portion 19, in the axial direction of the spindle main body 4. Before the bobbin 3 is attached to the spindle main body 4, the O-ring 17 is located on the front end side of the annular concave portion 19, as shown in FIG. 2. In a state in which the bobbin 3 is attached to the spindle main body 4, the O-ring 17 is pushed by the bobbin 3 and moved to the rear end side of the annular concave portion 19. When the bobbin 3 moves to the front side or in the circumferential direction with respect to the spindle main body 4 in this state, a resistance by friction of the O-ring 17 is applied.

The abutment member 18 is formed by a ring fitting on the rear end portion (the end portion on the side opposite to the electromagnetic brake 11) of the outer peripheral portion of the spindle base 13 and projects outward in the radial direction of the spindle base 13. A snap ring 20 engages at a position adjacent to the rear side of the abutment member 18 in the spindle base 13. The movement of the abutment member 18 to the rear side is impeded by the snap ring 20.

A lid body 22 is provided in the opening portion at the rear end of the spindle base 13 to make the gap between the spindle base 13 and a fixed attachment member 21 (to be described later) of the swing mechanism 12 as narrow as possible. The lid body 22 is formed into a ring shape by rubber or an elastomer, and fixed to the inner peripheral surface of the spindle base 13.

The support member 6 includes the cylindrical body 16 that supports the above-described spindle main body 4, and a columnar body 31 having a columnar shape and projecting backward from the rear end of the cylindrical body 16. The support member 6 is swingably supported by the fixed frame 5 via the swing mechanism 12 (to be described later) connected to the columnar body 31. The configurations of the columnar body 31 and the swing mechanism 12 will be described later.

(Brake) The electromagnetic brake 11 configured to implement the second function is connected to the front end portion of the cylindrical body 16. The electromagnetic brake 11 is positioned on the same axis as the cylindrical body 16 of the support member 6 and connected to the front end portion of the cylindrical body 16. Connection of the electromagnetic brake 11 to the cylindrical body 16 is done using a tubular body 32 having a cylindrical shape and forming a housing on the outermost side of the electromagnetic brake 11. As shown in FIG. 3, the tubular body 32 is fitted, from the front side, on the outer peripheral surface of a small-diameter portion 16*a* of the cylindrical body 16 and fixed to the small-diameter portion 16*a* by a plurality of fixing screws 33 that are screwed to the small-diameter portion 16*a* while extending through the tubular body 32 in the radial direction. In this embodiment, two fixing screws 33 are used. The fixing screws 33 are inserted into through holes 34 provided at two points of the tubular body 32 in the circumferential direction. The outer diameter of the tubular body 32 is the same as the outer diameter of a maximum-diameter portion 16*b* (see FIG. 2) located between the two bearings 7 and 8 of the cylindrical body 16.

The electromagnetic brake 11 according to this embodiment is formed by an electromagnetic powder brake. Note that the electromagnetic brake 11 may be formed by an electromagnetic hysteresis brake that is one of electromagnetic gap type brakes, although not illustrated. The electromagnetic hysteresis brake can be of an electromagnet type or a permanent magnet type, as disclosed in, for example, Japanese Patent No. 6392757. The electromagnetic hysteresis brake of the permanent magnet type includes a hysteresis member made of a magnetic material and configured to rotate integrally with a braking shaft, a plurality of permanent magnets arranged such that a magnetic flux passes through the hysteresis member. In the electromagnetic hysteresis brake of the permanent magnet type, the positions of the permanent magnets are changed by a motor, thereby controlling the magnitude of the braking force.

As shown in FIG. 3, the electromagnetic brake 11 (electromagnetic powder brake) according to this embodiment includes a field core 35 having a cylindrical shape and including the tubular body 32 (housing), and a braking shaft 40 rotatably supported at the two end portions of the field core 35 in the front-and-rear direction via spacers 36 and 37 and bearings 38 and 39.

The field core 35 includes an annular electromagnetic coil 41 fixed to the center portion of the inner peripheral portion of the tubular body 32 in the front-and-rear direction, a front core 42 and a rear core 43, which sandwich the electromagnetic coil 41 from both sides in the front-and-rear direction, a magnetic shielding ring 44 sandwiched between the front core 42 and the rear core 43 on the inner peripheral side of the electromagnetic coil 41, and the like. Each of the front core 42, the rear core 43, and the magnetic shielding ring 44 is formed into a ring shape. The magnetic shielding ring 44 impedes passage of a magnetic flux between the front core 42 and the rear core 43. A space generated between the front core 42 and the rear core 43 is filled with an insulating resin 45.

Lead wires 46 of the electromagnetic coil 41 are led out from the electromagnetic coil 41 to the rear side of the field core 35 through a long hole 47 extending in the front-and-rear direction of the tubular body 32 and guided into the cylindrical body 16 via a gap S1 between the cylindrical body 16 and the rear end of the field core 35. The lead wires 46 are guided to the rear end portion of the cylindrical body 16, and also derived to the outside of the spindle unit 1 while extending through the columnar body 31 to be described later and the fixed attachment member 21 of the swing mechanism 12, as shown in FIG. 1. The lead wires 46 are connected to a control device 48 to be described later.

Powder storage spaces S2 are formed between the spacers 36 and 37, the braking shaft 40, and the field core 35. The spacers 36 and 37 include seal members 49 and 50 configured to seal between the spacers 36 and 37 and the braking shaft 40, respectively. The seal members 49 and 50 are located between the pair of bearings 38 and 39 in the electromagnetic brake 11.

The braking shaft 40 is positioned on the same axis as the cylindrical body 16 of the support member 6 and extends through the pair of bearings 38 and 39 in the electromagnetic brake 11. A rotor 51 is fixed to a portion of the braking shaft 40 between the pair of bearings 38 and 39 to as to be integrally rotatable. The rotor 51 is formed into a disc shape extending outward in the radial direction while passing between the pair of spacers 36 and 37. The outer peripheral surface of the rotor 51 faces the inner peripheral surfaces of the front core 42 and the rear core 43 and the inner peripheral surface of the magnetic shielding ring 44 at a predetermined gap.

A powder 52 is encapsulated in the powder storage spaces S2. When the electromagnetic coil 41 is energized, the powder 52 is magnetically adsorbed to the inner peripheral surface of the field core 35 and the outer peripheral surface of the rotor 51, as shown in FIG. 3. FIG. 3 shows a state in which the electromagnetic coil 41 is energized, and the powder 52 is collected between the field core 35 and the rotor 51. The powder 52 is collected in this way, thereby applying a resistance when the rotor 51 rotates together with the braking shaft 40.

The front end portion of the braking shaft 40 projects frontward from the field core 35 and is connected to the front end portion of the above-described front tube 14 via a connecting mechanism 53. The connecting mechanism 53 includes a connecting pin 54 extending through the braking shaft 40, a lid member 55 provided at the front end portion of the front tube 14 to close the front end portion of the front tube 14, and a hole 56 formed in the lid member 55 such that the connecting pin 54 engages. The hole 56 is formed to extend through the lid member 55 while having an opening shape in which the braking shaft 40 and the connecting pin 54 are fitted.

The connecting pin 54 is press-fitted and fixed into the front end portion of the braking shaft 40 so as to cross the braking shaft 40. When the connecting pin 54 engages with the hole 56 of the lid member 55, the spindle main body 4 and the braking shaft 40 are connected such that these are interlocked via the connecting mechanism 53. Hence, when the electromagnetic brake 11 generates a braking force, a resistance can be applied to the rotating spindle main body 4.

Figure 4:
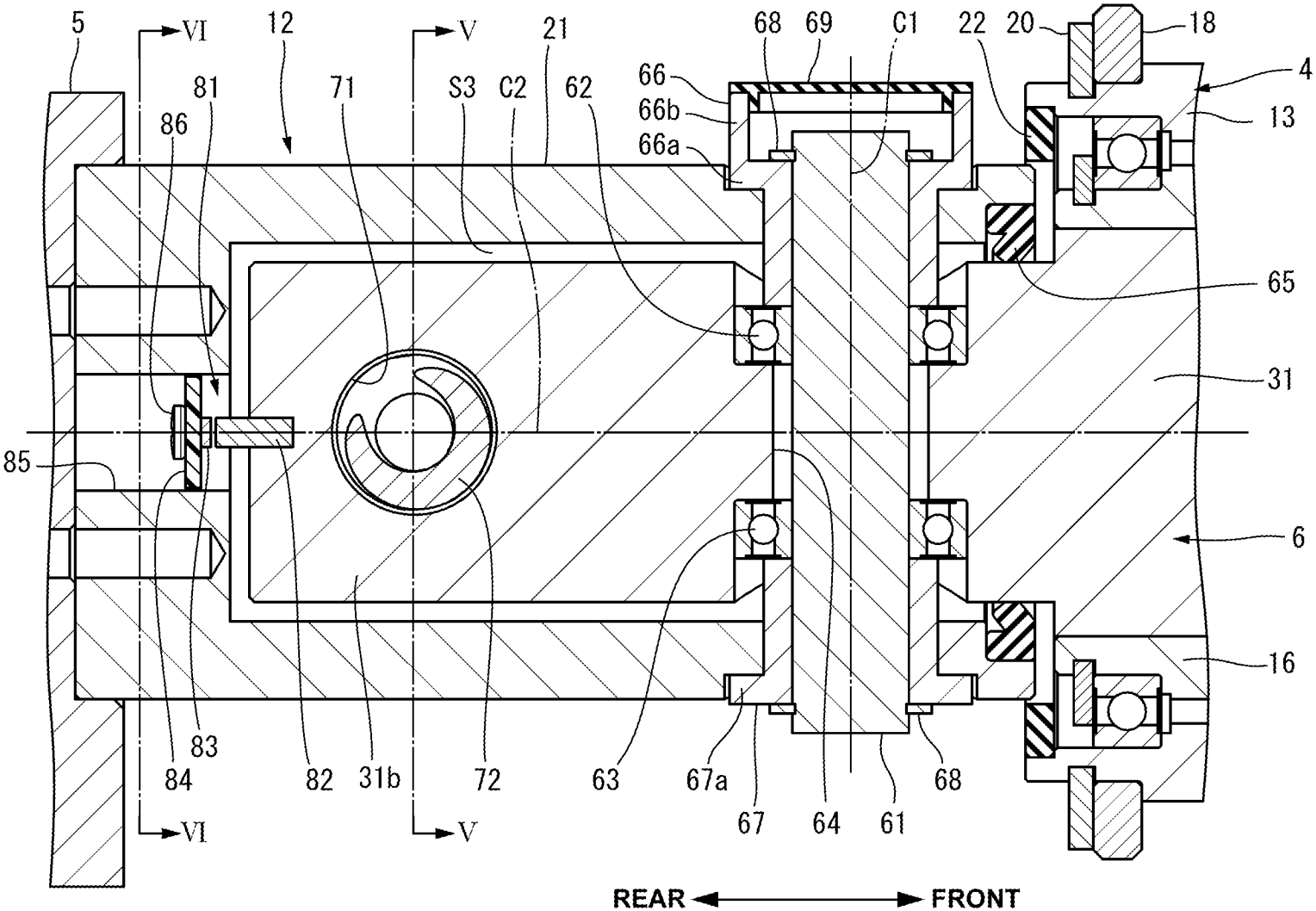
FIG. 4 is a sectional view of a swing mechanism.

(Columnar Body of Support Member) As for the columnar body 31 of the support member 6, as shown in FIG. 2, the front end portion of the columnar body 31 is press-fitted into the cylindrical body 16, and the columnar body 31 is connected to the cylindrical body 16 while being located on the same axis as the cylindrical body 16. Also, as shown in FIG. 4, the columnar body 31 is inserted, from the front side, into the fixed attachment member 21 (to be described later) of the swing mechanism 12, and swingably supported by a swing shaft 61 of the swing mechanism 12 via bearings 62 and 63. FIG. 4 is a sectional view showing a part of FIG. 2 in an enlarged state. The swing shaft 61 is inserted into a through hole 64 provided in the columnar body 31. The through hole 64 is formed in a direction orthogonal to (crossing) the axial direction of the support member 6 (columnar body 31).

(Swing Mechanism) The swing mechanism 12 is fixed to the fixed frame 5 and swingably supports the support member 6. As shown in FIG. 4, the swing mechanism 12 includes the fixed attachment member 21 fixed to the fixed frame 5, and the swing shaft 61 attached to the front end portion of the fixed attachment member 21. The fixed attachment member 21 is formed into a cylindrical shape. The inner diameter of the fixed attachment member 21 is larger than the outer diameter of the columnar body 31 such that a predetermined gap S3 is generated between the fixed attachment member 21 and the columnar body 31. The predetermined gap S3 is a gap that allows the support member 6 to swing by a predetermined angle about the swing shaft 61, as will be described later in detail.

A seal member 65 is provided between the columnar body 31 and the front end portion (the end portion in which the columnar body 31 is inserted) of the fixed attachment member 21. The seal member 65 is formed by an elastic body such as rubber or an elastomer, and closes the gap between the columnar body 31 and the front end portion of the fixed attachment member 21 while being held on the inner peripheral surface of the fixed attachment member 21. The seal member 65 elastically deforms while maintaining the seal state when the support member 6 swings with respect to the fixed attachment member 21 about the swing shaft 61.

The swing shaft 61 is formed into a cylindrical shape and extends through the fixed attachment member 21 so as to cross the fixed attachment member 21, and is also fixed at the both end portions to the fixed attachment member 21 via collars 66 and 67, respectively. The swing shaft 61 extends through the collars 66 and 67. That is, the two end portions of the swing shaft 61 are inserted into the collars 66 and 67, respectively and fixed to the fixed attachment member 21 in this state. The swing shaft 61 is fixed to the fixed attachment member 21 by attaching snap rings 68 to the two end portions projecting from the collars 66 and 67 in the vertical direction.

The collars 66 and 67 include flange portions 66*a* and 67*a*, respectively, to sandwich the fixed attachment member 21 from both sides in the vertical direction. In addition, the collar 66 located on the upper side of the fixed attachment member 21 includes a cylindrical projecting portion 66*b* that has a cylindrical shape and projects from the outer peripheral portion of the flange portion 66*a* in the axial direction (upward) of the swing shaft 61. The opening portion at the upper end of the cylindrical projecting portion 66*b* is closed by a dustproof cover 69.

The through hole 64 of the columnar body 31 is formed into a stepped shape in which the center portion has a diameter smaller than that of the two end portions. The above-described two collars 66 and 67 are inserted into the two end portions of the through hole 64. That is, the through hole 64 is formed to receive the swing shaft 61 and the collars 66 and 67.

The bearings 62 and 63 are provided between the hole wall of the through hole 64 and the center portion of the swing shaft 61. The bearings 62 and 63 swingably support the columnar body 31 such that the swing shaft 61 is located at the swing center. An axis C1 of the swing shaft 61 is orthogonal to an axis C2 of the fixed attachment member 21 having a tubular shape. The fixed attachment member 21 is attached to the fixed frame 5 such that the axis C1 of the swing shaft 61 and the direction of drawing the yarn 2 match. That is, as shown in FIG. 1, the fixed attachment member 21 is attached to the fixed frame 5 such that the swing shaft 61 extends in a direction orthogonal to the direction of drawing the yarn 2 (the direction indicated by an arrow A in FIG. 1). For this reason, when the yarn 2 is drawn, the support member 6 swings (tilts) about the swing shaft 61 such that a rear end portion 31*b* of the columnar body 31 on the rear side of the swing shaft 61 moves to the near side of FIG. 4.

Figure 5:
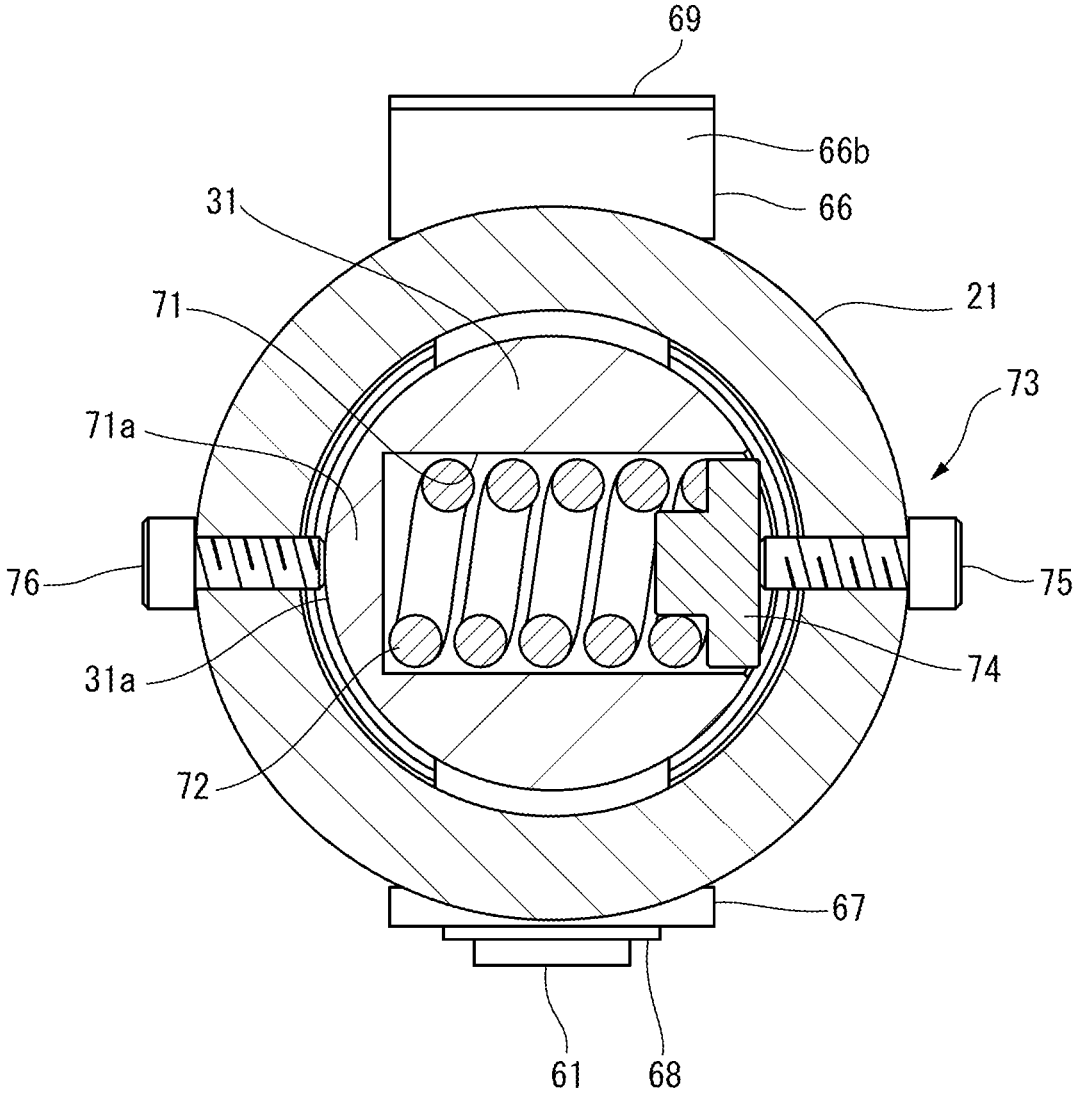
FIG. 5 is a sectional view of the spring portion of the swing mechanism.

As shown in FIG. 1, a concave portion 71 formed by a non-through hole is formed in the rear end portion 31*b* (extended portion) of the columnar body 31, that is, a portion on the side opposite to the cylindrical body 16 across the swing shaft 61. The opening shape of the concave portion 71 is circular. A spring 72 formed by a compression coil spring is stored in the concave portion 71, as shown in FIG. 5. The cutaway position of FIG. 5 is a position indicated by a line V-V in FIG. 4. The concave portion 71 is formed to extend in a direction orthogonal to the axial direction of the swing shaft 61 and the axial direction of the columnar body 31. The direction in which the concave portion 71 opens is the front (lower side in FIG. 1) in the moving direction of the support member 6 that swings about the swing shaft 61 when the yarn 2 is drawn.

(Spring Load Adjusting Mechanism) One end of the spring 72 abuts against a bottom 71*a* of the concave portion 71. The other end of the spring 72 is connected to the fixed attachment member 21 via a spring load adjusting mechanism 73 (spring load adjustor). The spring load adjusting mechanism 73 adjusts the spring force of the spring 72. The spring load adjusting mechanism 73 includes a disc-shaped spring receiving member 74 connected to the other end of the spring 72, and a spring load adjusting bolt 75 connected to the spring receiving member 74 and threadably engaging with the fixed attachment member 21. The spring receiving member 74 is inserted from the opening of the concave portion 71 and sandwiches the spring 72 with the bottom 71*a* of the concave portion 71. The spring force of the spring 72 applied to the spring receiving member 74 is received by the spring load adjusting bolt 75.

In the thus configured spring load adjusting mechanism 73, the position of the spring receiving member 74 can be changed in the compression direction or the extending direction of the spring 72 by forward/backward movement of the spring load adjusting bolt 75. When the position of the spring receiving member 74 moves in the compression direction of the spring 72, the spring force of the spring 72, that is, the force of pushing the columnar body 31 in the direction opposite to the spring load adjusting bolt 75 increases. On the other hand, when the position of the spring receiving member 74 moves in the extending direction of the spring 72, the spring force of the spring 72 decreases, and the force of pushing the columnar body 31 in the direction opposite to the spring load adjusting bolt 75 decreases. The spring force of the spring 72 is set such that a moment (clockwise moment in FIG. 1) for rotating the columnar body 31 about the swing shaft 61 in the direction opposite to the spring load adjusting bolt 75 and a moment (counterclockwise moment in FIG. 1) acting on the support member 6 when the yarn 2 is drawn from the bobbin 3 to which the resistance is applied by the electromagnetic brake 11 balance.

As shown in FIG. 5, a stopper bolt 76 threadably engages on the side of the fixed attachment member 21 opposite to the spring load adjusting bolt 75. The distal end of the stopper bolt 76 faces a front end 31*a* of the columnar body 31 in the swing direction when the columnar body 31 of the support member 6 is pushed (biased) by the spring 72 and swings. When the columnar body 31 is pushed by the spring 72 and swings, the stopper bolt 76 abuts against the front end 31*a* of the columnar body 31 to stop further swing of the columnar body 31. When the screw amount of the stopper bolt 76 into the fixed attachment member 21 is changed, the position at which the columnar body 31 stops while being biased by the spring 72, that is, the initial position can be changed. In a state in which the tension of the yarn 2 does not act on the spindle main body 4, the columnar body 31 is held at the initial position where it abuts against the stopper bolt 76. In a state in which the tension of the yarn 2 acts on the spindle main body 4, the moment when the support member 6 swings about the swing shaft 61 by the tension of the yarn 2 becomes larger than the moment when the support member 6 swings about the swing shaft 61 by the spring force of the spring 72, and the columnar body 31 swings in the direction of separating from the stopper bolt 76.

(Sensor) The swing mechanism 12 includes a swing angle detection sensor 81 (see FIGS. 1 and 2) configured to detect the tilt amount of the columnar body 31 when the columnar body 31 of the support member 6 swings by the tension of the yarn 2 against the spring force of the spring 72, as described above. As shown in FIG. 4, the sensor 81 according to this embodiment includes a first permanent magnet 82 provided in the axial portion at the rear end portion of the columnar body 31, and a first Hall element 83 provided at a position facing the rear end of the columnar body 31 in the fixed attachment member 21. The first permanent magnet 82 is formed into a columnar shape and is attached to the columnar body 31 while being located on the same axis as the columnar body 31 and partially projecting from the columnar body 31. The first Hall element 83 is mounted on a board package 84 and attached to the fixed attachment member 21 via the board package 84.

Figure 6:
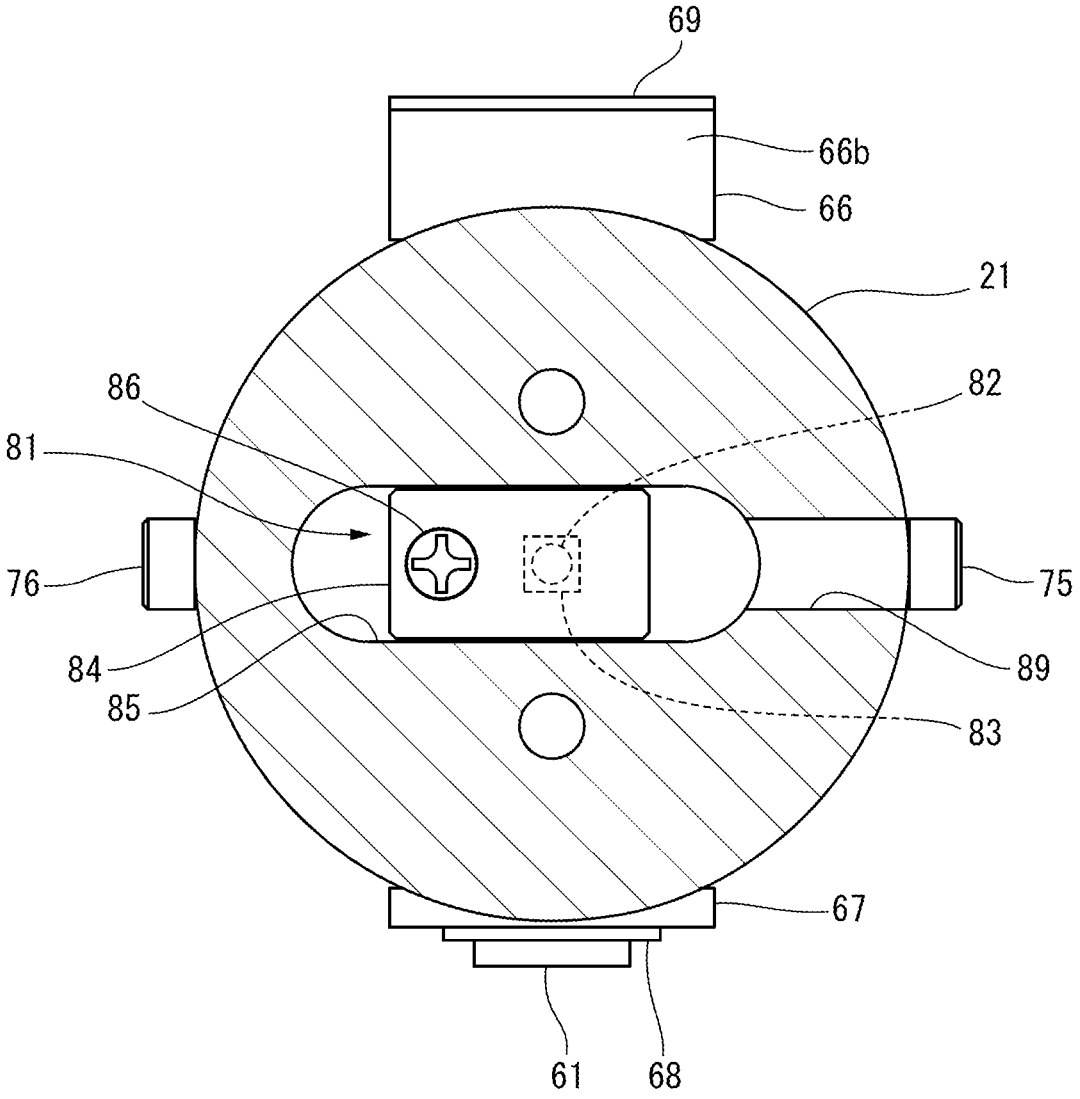
FIG. 6 is a sectional view of the sensor portion of the swing mechanism.

As shown in FIG. 6, as the rear end portion of the fixed attachment member 21, a long hole 85 is formed in the center portion of the swing shaft 61 in the axial direction (the vertical direction in FIG. 6). The cutaway position of FIG. 6 is a position indicated by a line VI-VI in FIG. 4. The long hole 85 extends in the swing direction (the left-and-right direction in FIG. 6) of the columnar body 31 when the support member 6 swings about the swing shaft 61. The board package 84 is stored in the long hole such that the first Hall element 83 faces the rear end face of the first permanent magnet 82.

The first Hall element 83 detects the magnetic flux of the first permanent magnet 82. The board package 84 is fixed by screwing an attachment screw 86 extending through the board package 84 to an attachment plate 87 of the fixed attachment member 21, as shown in FIG. 1. The attachment position of the board package 84 can be changed in the long hole 85 in the swing direction of the columnar body 31, and is set to a position where the detection state of the magnetic flux of the first permanent magnet 82 by the first Hall element 83 becomes a predetermined state. Hence, the sensor 81 formed by the first permanent magnet 82 and the first Hall element 83 detects the tilt amount of the columnar body 31 when the columnar body 31 swings about the swing shaft 61.

A signal representing the tilt amount of the columnar body 31 detected by the first Hall element 83 is sent to the control device 48 to be described later via a lead wire 88 (see FIG. 1). The lead wire 88 is derived to the outside of the fixed attachment member 21 through an outlet 89, which is formed in the fixed attachment member 21 to make the inside and the outside of the long hole 85 communicate, and connected to the control device 48 to be described later.

(Control Device) The control device 48 includes a CPU 91 that implements an arithmetic unit and a control unit, and a memory 92 that stores various kinds of information. The arithmetic unit obtains the current tension of the yarn 2 by an operation based on the tilt amount of the columnar body 31 detected by the first Hall element 83. The tilt amount can be obtained as, for example, the swing angle (tilt angle) of the columnar body 31 when swinging (tilting) from the initial position toward the spring load adjusting bolt 75. The memory 92 stores an equation or a table representing the relationship between the tilt amount of the columnar body 31 and the tension of the yarn 2 in advance, and the arithmetic unit may obtain the tension of the yarn 2 from the tilt amount of the columnar body 31 by referring to the equation or the table.

The control unit controls the braking force of the electromagnetic brake 11 such that the tension of the yarn 2 obtained by the arithmetic unit becomes a predetermined tension. For example, when the obtained tension is larger than a predetermined value, the braking force is decreased. When the obtained tension is smaller than the predetermined value, the braking force is increased.

(Operation of Spindle Unit) In the thus configured spindle unit 1, the braking force of the electromagnetic brake 11 is controlled such that the tension of the bobbin 3 becomes a predetermined tension when the yarn 2 is drawn from the bobbin 3. When the braking force of the electromagnetic brake 11 is zero, the columnar body 31 is held at the initial position, as shown in FIG. 1, and the yarn 2 is drawn from the bobbin 3 in this state. When the braking force of the electromagnetic brake 11 is increased in the state in which the yarn 2 is drawn, the tension of the yarn 2 increases, and the counterclockwise moment in FIG. 1 acts on the support member 6. When the magnitude of the counterclockwise moment becomes larger than that of the clockwise moment in FIG. 1, which rotates the support member 6 by the spring force of the spring 72, the support member 6 swings counterclockwise about the swing shaft 61 in FIG. 1.

Figure 7:
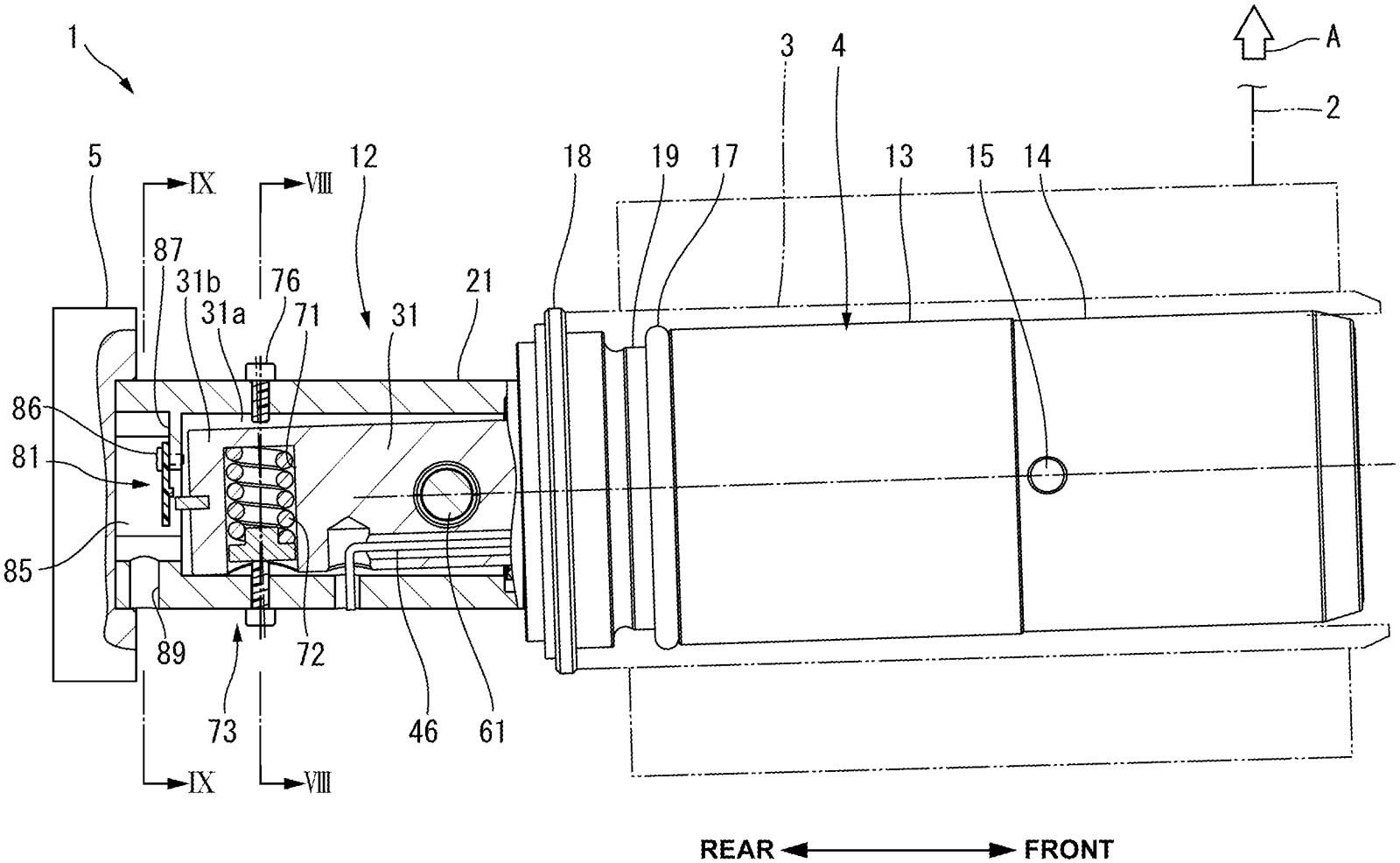
FIG. 7 is a plan view showing a spindle unit in which a main part is cut away.
Figure 8:
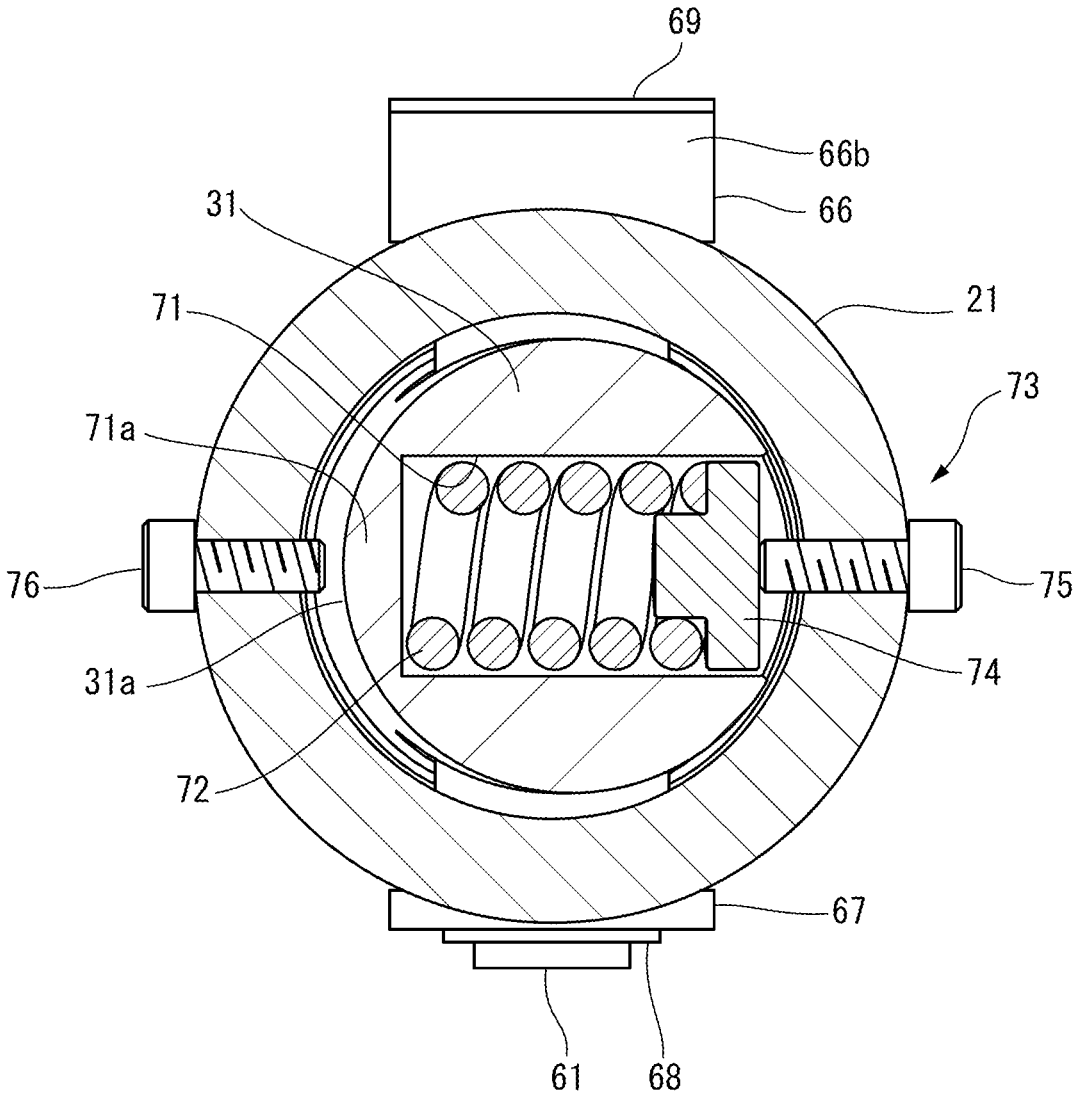
FIG. 8 is a sectional view of the spring portion of the swing mechanism.
Figure 9:
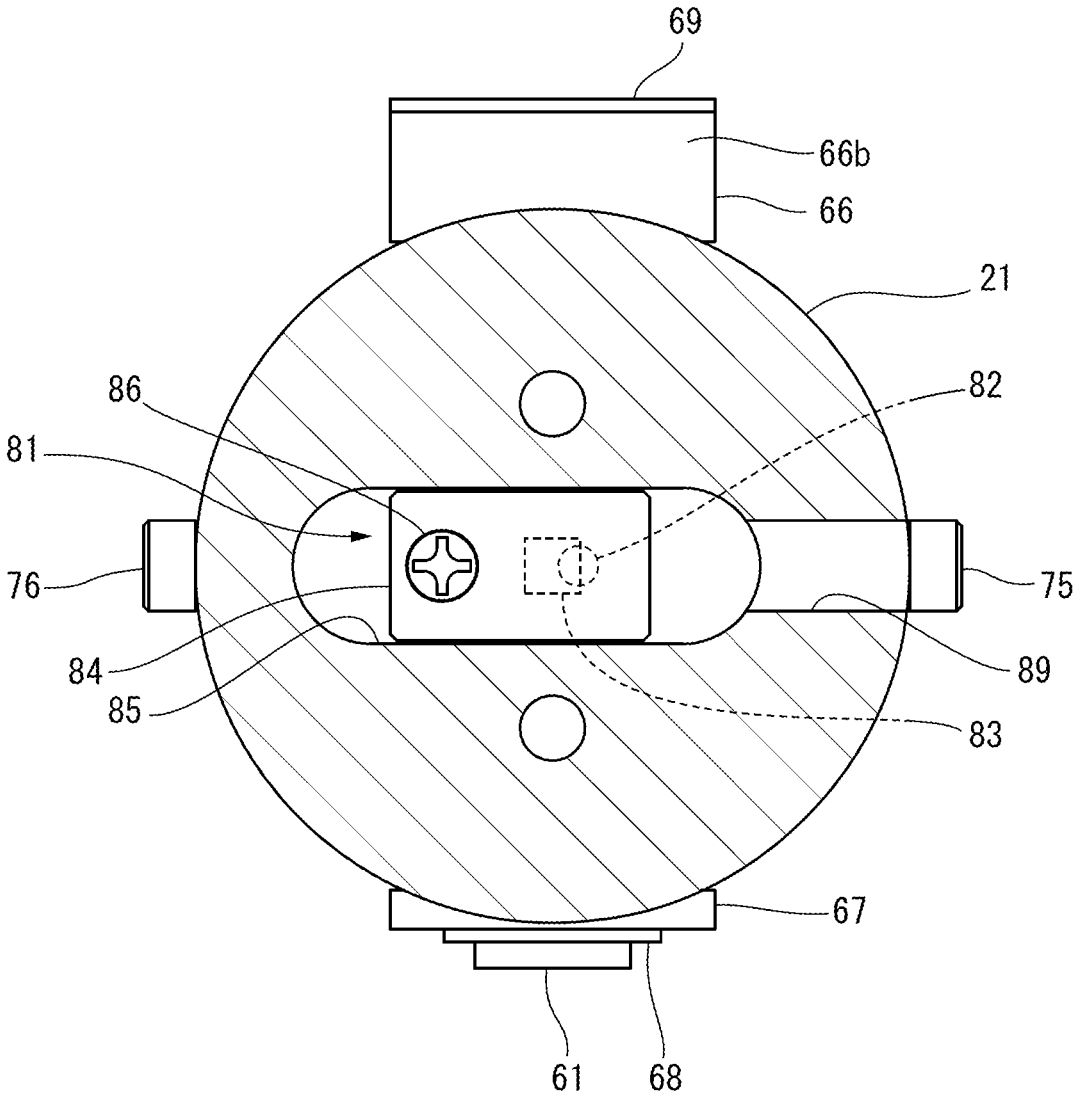
FIG. 9 is a sectional view of the sensor portion of the swing mechanism.

If the braking force of the electromagnetic brake 11 becomes larger than necessary, that is, if the tension of the yarn 2 is excessive, the rear end of the columnar body 31 hits the inner surface of the fixed attachment member 21, as shown in FIG. 7, and the columnar body 31 cannot swing anymore. As described above, in a state in which the columnar body 31 is located at the maximum swing position, the spring receiving member 74 wholly enters the concave portion 71, as shown in FIG. 8, and the first permanent magnet 82 largely separates from the first Hall element 83, as shown in FIG. 9. The cutaway position of FIG. 8 is a position indicated by a line VIII-VIII in FIG. 7. The cutaway position of FIG. 9 is a position indicated by a line IX-IX in FIG. 7. When the columnar body 31 is located at the maximum swing position, the control device 48 decreases the braking force of the electromagnetic brake 11.

The control device 48 controls the braking force of the electromagnetic brake 11 such that the columnar body 31 is located between the initial position and the maximum swing position. For example, when the tilt amount of the columnar body 31 is a value representing the initial position, the braking force is increased. When the tilt amount of the columnar body 31 reaches a value representing the maximum swing position, the braking force is decreased. Controlling the braking force of the electromagnetic brake 11 in this way means that the tension of the yarn 2 becomes an almost constant predetermined tension.

Hence, the spindle unit 1 according to this embodiment is inexpensive because an expensive ultrasonic sensor is not used to detect the tension of the yarn 2, and can easily detect the tension of the yarn 2 in a noncontact state.

(Effects) The spindle unit 1 according to this embodiment includes the swing mechanism 12 fixed to the fixed frame 5, the support member 6 swingably supported by the swing mechanism 12, the spindle main body 4 rotatably supported by the support member 6, and the electromagnetic brake 11 supported by the support member 6. The spindle main body 4 is detachably inserted into the axial portion of the bobbin 3 around which a yarn is wound and rotates integrally with the bobbin 3. The electromagnetic brake 11 applies a resistance to the spindle main body 4 when the spindle main body 4 is rotating.

The swing mechanism 12 includes the fixed attachment member 21 fixed to the fixed frame 5, the swing shaft 61 supported by the fixed attachment member 21, the spring 72, and the sensor 81. The swing shaft 61 supports the support member 6 such that the support member 6 swings by the tension of the yarn 2 when the yarn 2 is drawn from the bobbin 3. The spring 72 applies a spring force of the spring 72 to the support member 6 in a direction opposite to the direction in which the support member 6 swings by the tension of the yarn 2. The sensor 81 detects the tilt amount of the support member 6 when the support member 6 swings by the tension of the yarn 2 against the spring force of the spring 72.

When the tension of the yarn 2 acts on the bobbin 3, the support member 6 swings about the swing shaft 61 against the spring force of the spring 72, and the tilt amount of the support member 6 is detected by the sensor 81. It is therefore possible to easily and inexpensively detect the tension of the yarn 2 in a noncontact state.

The support member 6 includes a rear end portion 31*b* extending to the side opposite to the spindle main body 4 across the swing shaft 61. The sensor 81 electrically detects the tilt amount of the columnar body 31 with respect to the fixed frame 5 or the fixed attachment member 21. Since the columnar body 31 can be formed shorter than the spindle main body 4 inserted into the bobbin 3, the tilt amount of the distal end can be made smaller than that of the spindle main body 4. For this reason, since the sensor 81 can be constructed compact, the size of the spindle unit 1 can be reduced.

The sensor 81 includes the first permanent magnet 82, and the first Hall element 83 configured to detect the magnetic flux of the first permanent magnet 82. The first permanent magnet 82 is provided in the columnar body 31, and the first Hall element 83 is provided in the fixed attachment member 21 on the side of the fixed frame 5. Hence, since the influence of dust such as lint is absent when measuring the tilt amount of the columnar body 31 the tilt amount of the columnar body 31 can accurately be measured.

The swing mechanism 12 includes the stopper bolt 76 configured to abut against the front end 31*a* of the support member 6 in the swing direction when the support member 6 is biased by the spring 72 and swings. The stopper bolt 76 threadably engages with the fixed attachment member 21 such that the distal end of the stopper bolt 76 faces the front end 31*a* of the support member 6. Hence, when the screw amount of the stopper bolt 76 is changed, the initial position at which the support member 6 is pushed by the spring 72 and stops with respect to the fixed attachment member 21 can be adjusted.

The spring 72 is stored in the concave portion 71 provided in the support member 6. One end of the spring 72 abuts against the bottom 71*a* of the concave portion 71, and the other end of the spring 72 is in contact with the spring receiving member 74 and is also connected to the fixed attachment member 21 via the spring load adjusting mechanism 73 including the spring receiving member 74. The spring load adjusting mechanism 73 is configured to be able to change the position of the spring receiver 74 in the compression direction or the extending direction of the spring 72. Hence, since the spring force of the spring 72 can be changed using the spring load adjusting mechanism 73, a wide adjustment width can be ensured when adjusting the tension of the yarn 2.

The fixed attachment member 21 is formed into a tubular shape and projects from the fixed frame 5. The swing shaft 61 is formed into a columnar shape. The support member 6 includes the cylindrical body 16 configured to support the spindle main body 4, and the columnar body 31 projecting from the cylindrical body 16 and inserted into the fixed attachment member 21. The columnar body 31 includes the through hole 64 formed in a direction crossing (orthogonal to) the axial direction of the support member 6. The swing shaft 61 and the collars 66 and 67 are inserted into the through hole 64. The swing shaft 61 extends through the fixed attachment member 21 so as to cross the fixed attachment member 21. The two end portions of the swing shaft 61 are fixed to the fixed attachment member 21 via the cylindrical collars 66 and 67, respectively. The bearings 62 and 63 are provided between the hole wall of the through hole 64 and the center portion of the swing shaft 61. The columnar body 31 is swingably supported by the bearings 62 and 63 to the swing shaft 61. Since the support member 6 can swingably supported by the fixed attachment member 21 and one swing shaft 61 extending through the intermediate portion of the support member 6, the structure that supports the support member 6 is simple and easy to assemble.

Of the two collars 66 and 67, the collar 66 located on the upper side of the fixed attachment member 21 includes the cylindrical projecting portion 66*b* projecting from an end of the swing shaft 61 in the axial direction. The cylindrical projecting portion 66*b* is closed by the dustproof cover 69. It is therefore possible to prevent, by the dustproof cover 69, dust such as lint from entering the bearings 62 and 63 configured to support the support member 6. Note that the collar 67 located on the lower side of the fixed attachment member 21 may include a cylindrical projecting portion closed by a dustproof cover.

The swing mechanism 12 includes the seal member 65 made of an elastic body configured to close the gap between the front end portion of the fixed attachment member 21 and the columnar body 31 of the support member 6. It is therefore possible to prevent, by the seal member 65, dust such as lint from entering inside from the distal end side of the fixed attachment member 21. Note that although not illustrated, the rear end portion of the spindle main body 4 can be formed to overlap the front end portion of the fixed attachment member 21 in the axial direction, and a labyrinth seal can be formed by these. When this configuration is employed, it is more difficult for dust to enter the portion sealed by the seal member 65, and the sealing performance can be further improved.

(Second Embodiment) A spindle unit according to the second embodiment of the present invention will be described with reference to FIGS. 10 and 11. The same reference numerals as those described with reference to FIGS. 1 to 9 denote the same or similar members in these drawings, and a detailed description thereof will be omitted.

Figure 10:
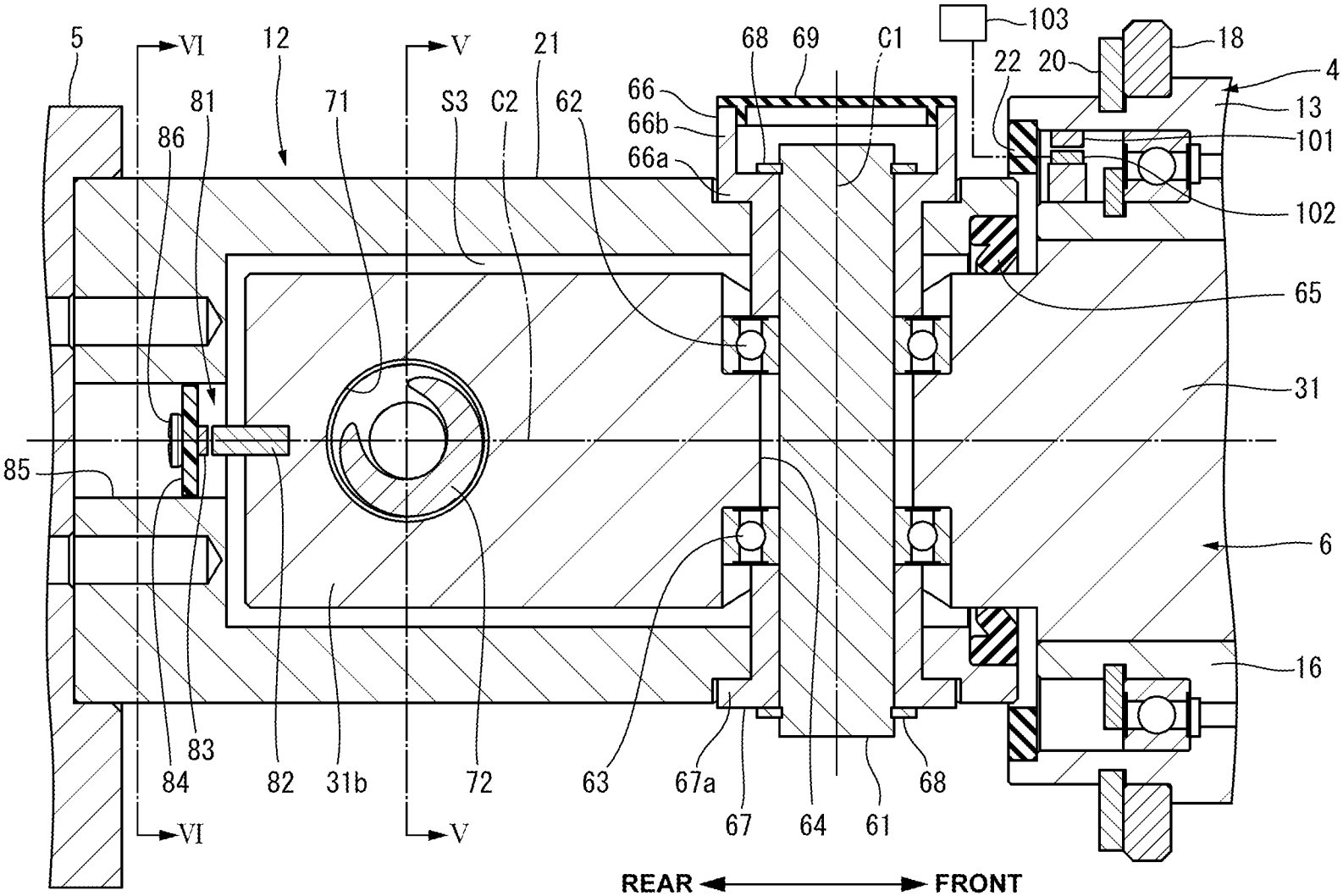
FIG. 10 is a sectional view showing a part of a spindle unit according to the second embodiment in an enlarged state.

One second permanent magnet 101 is provided on the inner peripheral portion of one end portion (rear end portion) of a spindle main body 4, shown in FIG. 10, close to a swing shaft 61. In addition, a second Hall element 102 configured to detect the magnetic flux of the second permanent magnet 101 is provided at one end portion (rear end portion) of a cylindrical body 16 of a support member 6 close to the swing shaft 61. A detector 103 is connected to the second Hall element 102. The detector 103 obtains an electrical signal pulse corresponding to the rotation of the spindle main body 4 based on the output of the second Hall element 102. With this configuration, the rotational speed of the spindle main body 4 can be detected.

If this configuration is employed, the spindle main body 4 is made of an aluminum alloy, thereby raising the accuracy of the detected rotational speed. Also, in this case, the second permanent magnet 101 is arranged at the lightest position for ensuring static balance of the spindle main body 4 with respect to the support member 6. More specifically, the second permanent magnet 101 can be arranged at the closest position to the swing shaft 61. This position is a location where the influence is small upon swinging. When this configuration is employed, the static balance of the spindle main body 4 can be ensured using the second permanent magnet 101.

Figure 11:
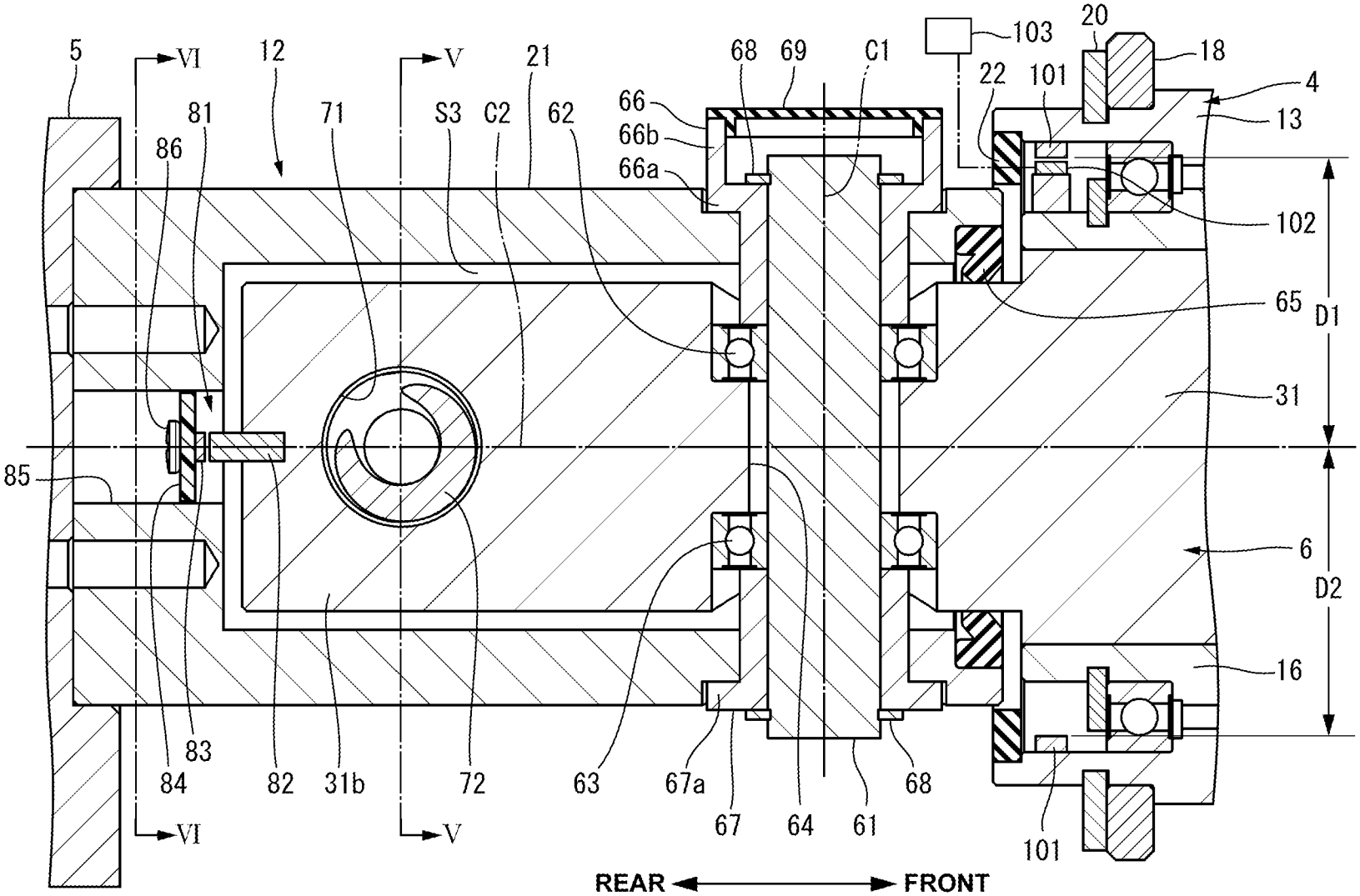
FIG. 11 is a sectional view showing a modification of a second permanent magnet according to the second embodiment.

When employing the configuration for detecting the rotation of the spindle main body 4 by the second permanent magnet 101 and the second Hall element 102, a plurality of second permanent magnets 101 can be used, as shown in FIG. 11. The spindle main body 4 shown in FIG. 11 is made of an aluminum alloy, and two second permanent magnets 101 are provided on the inner peripheral portion of one end portion of the spindle main body 4 close to the swing shaft 61. The second permanent magnets 101 are provided at a plurality of positions at equal intervals in the circumferential direction of the spindle main body 4.

Concerning the radial direction of the spindle main body 4, the second permanent magnets 101 are arranged at positions equidistant from the axis of the spindle main body 4. That is, a distance D1 between one second permanent magnet 101 and the axis of the spindle main body 4 and a distance D2 between the other second permanent magnet 101 and the axis of the spindle main body 4 equal. When the plurality of second permanent magnets 101 are provided in the spindle main body 4, the rotation can be detected by providing the second permanent magnets 101 in the spindle main body 4 without degrading the static balance of the spindle main body 4.

(Modifications) While the invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims.

For example, in the above-described embodiment, the first permanent magnet 82 is provided in the columnar body 31, and the first Hall element 83 is provided in the fixed attachment member 21. However, the first permanent magnet 82 can be provided in the fixed attachment member 21, and the first Hall element 83 can be provided in the columnar body 31. Even if such a configuration is employed, the tilt amount of the support member 6 can be measured, as in the above-described embodiment.

Also, in the above-described embodiment, the electromagnetic brake 11 is provided in the front end portion of the spindle main body 4. However, the position to provide the electromagnetic brake 11 can be changed as needed. For example, the electromagnetic brake 11 can be arranged between the swing shaft 61 and the rear end portion of the spindle main body 4. In addition, the electromagnetic brake 11 can be supported by the cylindrical body 16 while being arranged on a side of the support member 6 in a state in which the axis of the electromagnetic brake 11 becomes parallel to the spindle main body 4, and the braking shaft 40 of the electromagnetic brake 11 can be connected to the spindle main body 4 by a transmission mechanism such as a gear or a belt.

What is claimed is:

1. A spindle unit comprising:

a swing mechanism fixed to a fixed frame;

a support member swingably supported by the swing mechanism;

a spindle main body rotatably supported by the support member, detachably inserted into an axial portion of a bobbin around which a yarn is wound, and configured to rotate integrally with the bobbin; and an electromagnetic brake supported by the support member and configured to apply a resistance to the spindle main body when the spindle main body is rotating, wherein the swing mechanism includes:

a fixed attachment member fixed to the fixed frame;

a swing shaft supported by the fixed attachment member and configured to support the support member such that the support member swings by a tension of the yarn when the yarn is drawn from the bobbin;

a spring configured to apply a spring force to the support member in a direction opposite to a direction in which the support member swings by the tension of the yarn; and a sensor configured to detect a tilt amount of the support member when the support member swings by the tension of the yarn against the spring force of the spring.

2. The spindle unit according to claim 1, wherein the support member includes an extended portion extending to a side opposite to the spindle main body across the swing shaft, and the sensor is configured to electrically detect the tilt amount of the extended portion with respect to the fixed attachment member.

3. The spindle unit according to claim 2, wherein the sensor includes:

a first permanent magnet installed in one of the fixed attachment member and the extended portion; and a first Hall element installed in the other of the fixed attachment member and the extended portion and configured to detect a magnetic flux of the first permanent magnet.

4. The spindle unit according to claim 1, wherein the swing mechanism further includes a stopper bolt configured to abut against a front end of the support member in a swing direction when the support member is biased by the spring and swings, the stopper bolt threadably engaging with the fixed attachment member such that a distal end of the stopper bolt faces the front end of the support member.

5. The spindle unit according to claim 1, wherein the support member includes a concave portion configured to store the spring, the concave portion includes a bottom configured to abut against one end of the spring, the swing mechanism includes a spring load adjustor configured to adjust the spring force of the spring, and the spring load adjustor includes a spring receiving member configured to come into contact with the other end of the spring, a position of the spring receiving member being changeable in one of a compression direction and an extending direction of the spring.

6. The spindle unit according to claim 5, wherein the spring load adjustor further includes a spring load adjusting bolt connected to the spring receiving member and threadably engaging with the fixed attachment member.

7. The spindle unit according to claim 1, wherein the fixed attachment member is formed into a tubular shape and projects from the fixed frame, the swing shaft is formed into a columnar shape, the support member includes a tubular body configured to support the spindle main body, and a columnar body projecting from the tubular body and inserted into the fixed attachment member, the columnar body includes a through hole which is formed in a direction crossing an axial direction of the support member and into which the swing shaft is inserted, and a bearing installed between a hole wall of the through hole and a center portion of the swing shaft, and two end portions of the swing shaft are fixed to the fixed attachment member.

8. The spindle unit according to claim 7, wherein the swing mechanism further includes two collars each having a cylindrical shape, and the two end portions of the swing shaft are fixed to the fixed attachment member in a state in which the end portions are inserted into the collars.

9. The spindle unit according to claim 8, wherein at least one of the two collars includes a cylindrical projecting portion projecting from an end of the swing shaft in an axial direction of the swing shaft, and the swing mechanism further includes a dustproof cover configured to close the cylindrical projecting portion.

10. The spindle unit according to claim 7, wherein the swing mechanism further includes a seal formed by an elastic body configured to close a gap between the columnar body and an end portion of the fixed attachment member into which the columnar body is inserted.

11. The spindle unit according to claim 1, further comprising:

a second permanent magnet installed at an end portion of the spindle main body close to the swing shaft;

a second Hall element installed at an end portion of the support member close to the swing shaft and configured to detect a magnetic flux of the second permanent magnet; and a detector configured to obtain an electrical signal pulse corresponding to rotation of the spindle main body based on an output of the second Hall element.

12. The spindle unit according to claim 11, wherein the spindle main body is made of an aluminum alloy, and the second permanent magnet includes one magnet arranged at a lightest position for ensuring static balance of the spindle main body with respect to the support member.

13. The spindle unit according to claim 11, wherein the spindle main body is made of an aluminum alloy, and the second permanent magnet includes a plurality of magnets arranged at equal intervals in a circumferential direction of the spindle main body and at positions equidistant from an axis of the spindle main body in a radial direction of the spindle main body.

14. The spindle unit according to claim 1, further comprising a CPU configured to obtain the tension of the yarn based on the tilt amount of the support member detected by the sensor.

15. The spindle unit according to claim 14, wherein the CPU is configured to control the electromagnetic brake such that the obtained tension of the yarn becomes a predetermined tension.

* * * * *